US007228627B1

(12) United States Patent
Yoshimura et al.

(10) Patent No.: US 7,228,627 B1
(45) Date of Patent: Jun. 12, 2007

(54) METHOD OF MANUFACTURING A HIGH STRENGTH ALUMINUM-CLAD STEEL STRAND CORE WIRE FOR ACSR POWER TRANSMISSION CABLES

(75) Inventors: Hironori Yoshimura, Greenville, SC (US); Thomas J. Higham, Simpsonville, SC (US); Henry T. Jarboe, Jr., Moore, SC (US)

(73) Assignee: United States Alumoweld Co., Inc., Duncan, SC (US)

( * ) Notice: Subject to any disclaimer, the term of this patent is extended or adjusted under 35 U.S.C. 154(b) by 0 days.

(21) Appl. No.: 11/305,529

(22) Filed: Dec. 16, 2005

(51) Int. Cl.
*H01R 43/033* (2006.01)
*H01B 5/08* (2006.01)

(52) U.S. Cl. ..... 29/872; 29/868; 29/605; 174/108; 174/126.1; 174/128.1; 174/128.2

(58) Field of Classification Search ..... 29/872, 29/868, 605, 606, 857, 869; 174/126.1, 126.2, 174/128.1, 128.2, 130, 108, 109; 140/118, 140/149
See application file for complete search history.

(56) References Cited

U.S. PATENT DOCUMENTS 3,646,796 A 3/1972 Tanaka et al.
3,813,481 A 5/1974 Adams
3,813,772 A 6/1974 Adams
5,335,527 A 8/1994 Nagai et al.
5,554,826 A 9/1996 Gentry
6,242,693 B1 6/2001 Abe et al.
6,559,385 B1 * 5/2003 Johnson et al. ..... 174/126.1
2002/0079127 A1 6/2002 Miyakawa et al.

FOREIGN PATENT DOCUMENTS

JP 356126018 A 10/1981
JP 7-302518 * 11/1995
JP 411306880 A 11/1999

* cited by examiner

*Primary Examiner*—A. Dexter Tugbang
(74) *Attorney, Agent, or Firm*—Leatherwood Walker Todd & Mann, P.C.; Thomas W. Epting

(57) ABSTRACT

A manufacturing method is provided to form an overhead transmission cable having an elongated stranded steel core, and at least one layer of conductor wires generally encircling the stranded steel core. Each conductor wire includes a circumferentially extending, metallurgically bonded aluminum outer layer of at least 99.5 percent pure aluminum and having an IACS conductivity of at least 20.3 percent. In one embodiment, the steel conductors include a generally circular cross-section and an aluminum outer layer metallurgically bonded thereto, with the thickness of the aluminum outer layer being at least 10 percent of the overall radial dimension of the conductor.

3 Claims, 3 Drawing Sheets

METHOD OF MANUFACTURING A HIGH STRENGTH ALUMINUM-CLAD STEEL STRAND CORE WIRE FOR ACSR POWER TRANSMISSION CABLES

BACKGROUND OF THE INVENTION

This invention relates generally to cable, and in particular, aluminum conductor steel reinforced (ACSR) power transmission conductors having core strands with metallurgically-bonded aluminum.

Conventional electrical overhead ACSR power transmission cable typically includes a steel core which may be galvanized for corrosion resistance. Aluminum wires are ordinarily helically wound about the steel core, and the steel core itself is ordinarily formed of a number of steel wires which are themselves stranded together.

In a conventional overhead transmission conductor, the steel core typically carries substantially the entire mechanical tension load placed on the cabling between poles or towers, and the aluminum wires carry the bulk of the electricity transmitted.

It is generally desirable to reduce the weight of cabling in order to reduce tension loads, reduce structural strength requirements, overall cost, etc.

It is also desirable, in those environments where the potential for corrosion is high, such as in coastal applications, to provide ACSR power transmission cable with improved resistance to corrosion.

SUMMARY OF THE INVENTION

Generally, the present invention includes an overhead transmission cable having a core wire with a carbon steel inner portion. At least one layer of conductor wires generally encircles the core wire, and an aluminum outer layer is metallurgically bonded to the carbon steel inner portion. The aluminum outer layer has a conductivity of at least 20.3 percent IACS, and the core wire has an ultimate tensile strength of at least 200 ksi. Preferably the aluminum outer layer of the core wire is of a thickness of at least five percent of the thickness of the core wire.

More specifically, each of the steel conductors preferably includes a generally circular cross-section with the thickness of the aluminum outer layer being at least 10 percent of the overall radial dimension of such conductor.

The present invention also includes a method of constructing an overhead transmission cable, and includes providing core wire constructed in accordance with the present invention, such as cladding a core wire with aluminum, and wrapping the core strand with at least one layer of conductor wires.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
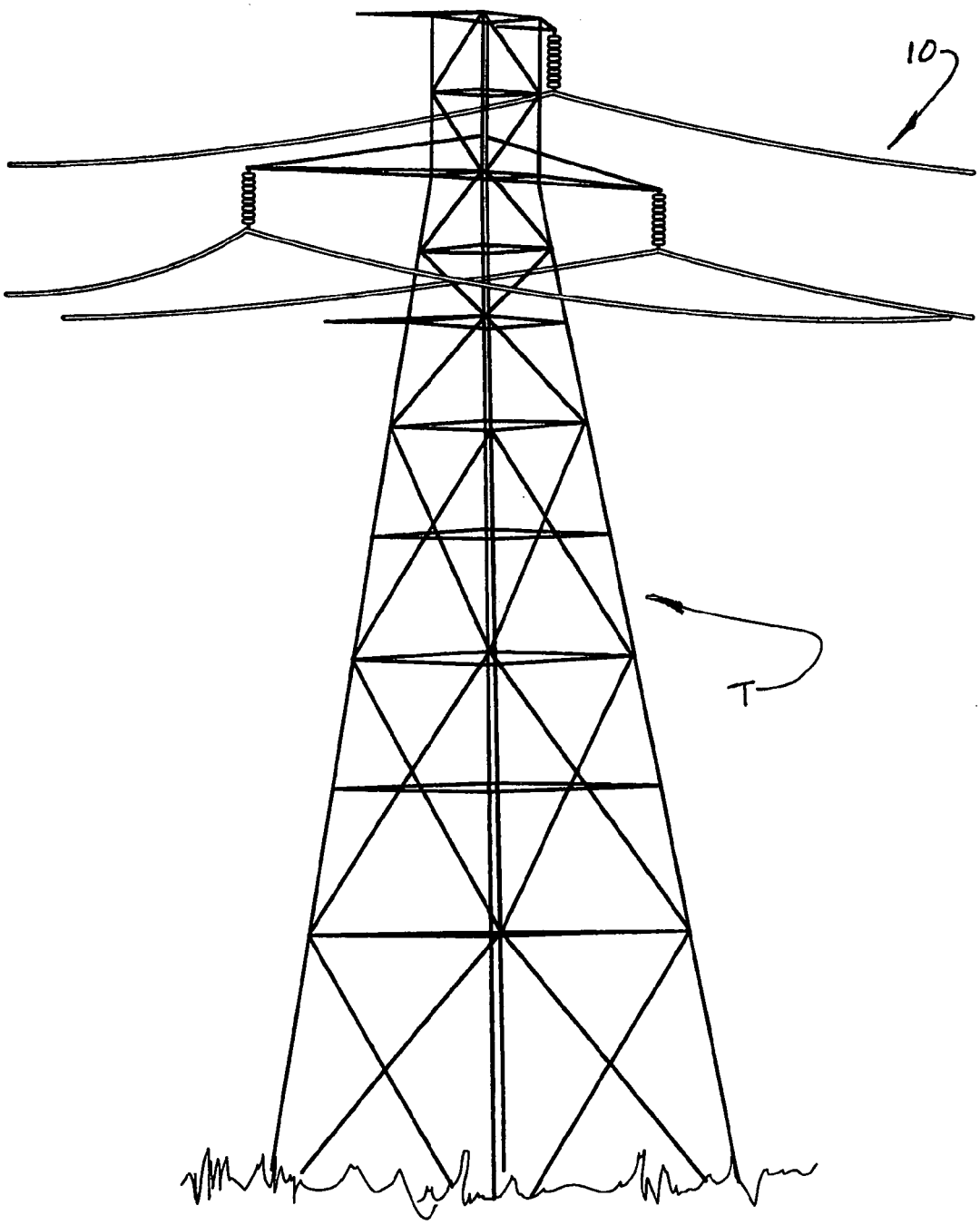
FIG. 1 is a perspective view of a tower carrying an overhead transmission conductor, such as the overhead transmission cable constructed in accordance with the present invention.

The foregoing, as well as other objects of the present invention, will be further apparent from the following detailed description of the preferred embodiment of the invention, when taken together with the accompanying drawings and the description which follows set forth this invention in its preferred embodiment. However, it is contemplated that persons generally familiar with power transmission cable will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the high strength aluminum-clad steel strand core for an ACSR power transmission cable of the present invention is indicated generally in the figures by reference character 10.

Turning to FIG. 1, a utility tower, generally T, is illustrated having aluminum-clad core wire in an ACSR power transmission cable 10, or, generally, cable 10, constructed in accordance with the present invention being carried by the tower T. It is to be understood that while tower T is used in high tension power transmission conductor applications, other tower structures, poles, posts, support arms, etc. can be used in accordance with carrying the cable of the present invention also. Accordingly, it is to be understood that cable 10 is not limited to the tower, generally T, illustrated in FIG. 1.

Figure 2:
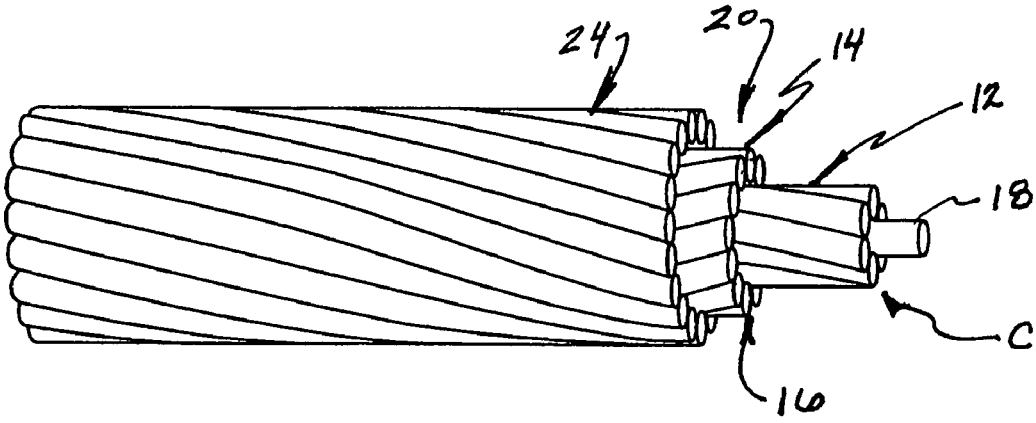
FIG. 2 is a perspective view of an ACSR cable constructed in accordance with the present invention having a core strand encircled with at least one layer of conductor wires in a generally helical manner.

FIG. 2 illustrates one preferred embodiment of cable 10. Cable 10 includes an overhead transmission conductor or cable, having elongated stranded steel core wires, generally 12, and at least one layer 14 of conductor wires, generally 16, encircling a stranded steel core, generally core C, in a generally helical fashion.

Cable 10 includes a central core strand, generally 18, preferably constructed of aluminum clad carbon steel. Core C includes seven core wires 12, and in a preferred embodiment, each core wire includes a metallurgically bonded aluminum outer skin. The next layer, generally 20, of wires could also be aluminum clad carbon steel, or, conductor wires 16 constructed of aluminum, in which case an outer layer 24 of cable 10 would ordinarily be aluminum conductor wires 16.

As shown in FIG. 2, the core wires 12 and each of wire layers 14, 22 is wound in a generally helical manner about central core wire 18. Preferably, the helical winding patterns alternate from one layer to the next. For example, in FIG. 2, the helical winding direction of innermost wire layer 14 of core C is wound in a generally counterclockwise direction, when the segment of cable 10 shown in FIG. 2 is viewed from the rightmost end. The middle layer 20 of cable 10 is, in contrast, helically wound in a generally counter-clockwise fashion, and the outer layer 24 is wound in the opposite direction of the middle layer, in other words, in a generally counter-clockwise direction.

Cable 10, as illustrated in FIG. 2 is known as a "seven wire core" cable. It is to be understood, however, that the present invention is not limited to the embodiment illustrated in FIG. 2, FIG. 3A, or FIG. 3B. Cable 10 and alternate embodiments, such as cable 10' shown in FIG. 3A and cable 10" shown in FIG. 3B, are for illustrative purposes only, and more or less core wires, core strand layers, and conductor layers could be used, as could also conductors and core strands of differing cross-sectional shapes and/or profiles, differing diameters and relative diameters than that shown in the drawings, depending on the application and the desired end product cable.

Figure 3A:
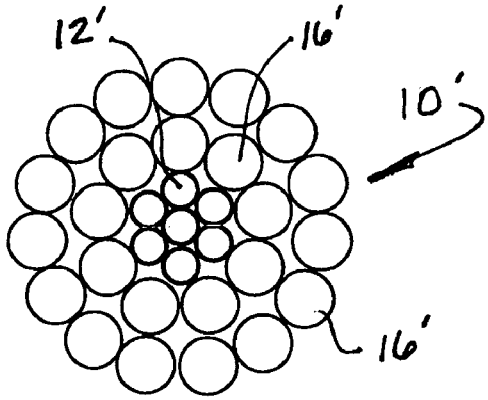
FIG. 3A is a sectional view of an alternate embodiment ACSR cable constructed in accordance with the present invention.

FIG. 3A illustrates one alternate embodiment of the present invention, namely, cable 10'. Cable 10'includes a seven wire core C' that includes two layers of conductor wires 16' being of larger diameter than core wires 12'. Also, the number of conductor wires 16' is less than that depicted in connection with cable 10, illustrated in FIG. 2.

Figure 3B:
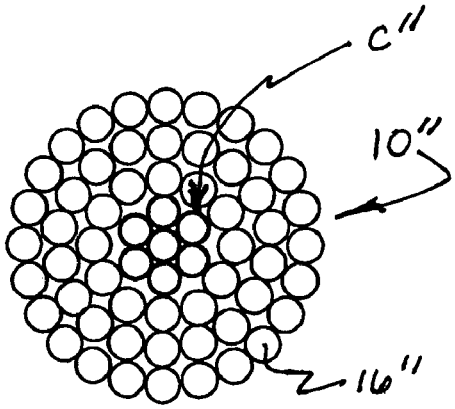
FIG. 3B is a sectional view of a second alternate embodiment ACSR cable constructed in accordance with the present invention.

FIG. 3B illustrates a second alternate embodiment, cable 10" and includes a nineteen wire core strand C" with two layers of conductor wires 16" encircling core strand C".

Although not shown, a core strand could simply be one wire, if desired, or it could include more wires than the nineteen wire core strand illustrated in FIG. 3B.

Figure 4A:
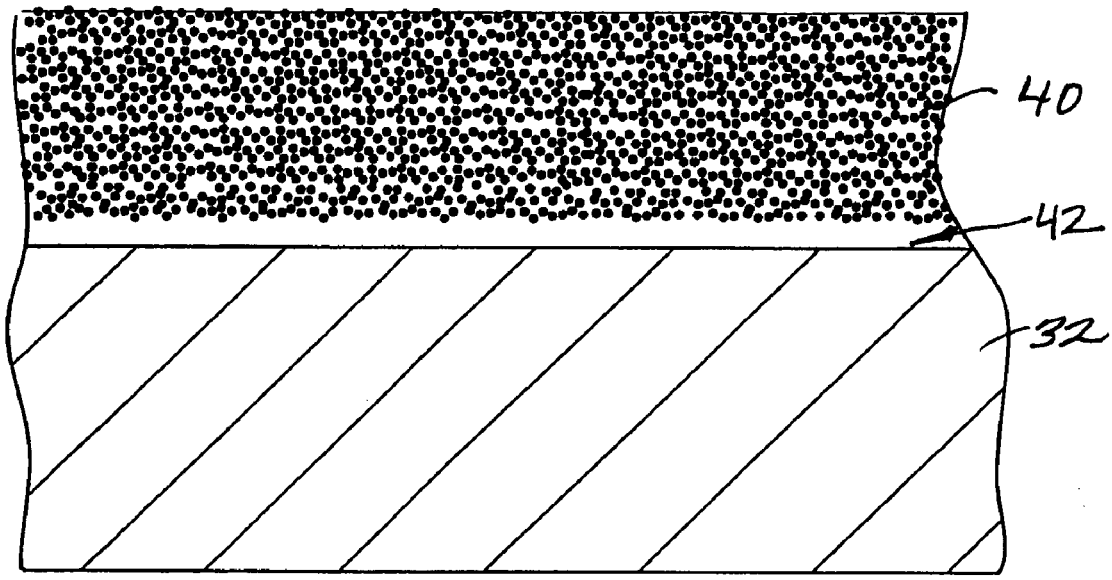
FIG. 4A is a graphical representation of a micrograph showing a non-metallurgically bonded aluminum coating of steel.
Figure 4B:
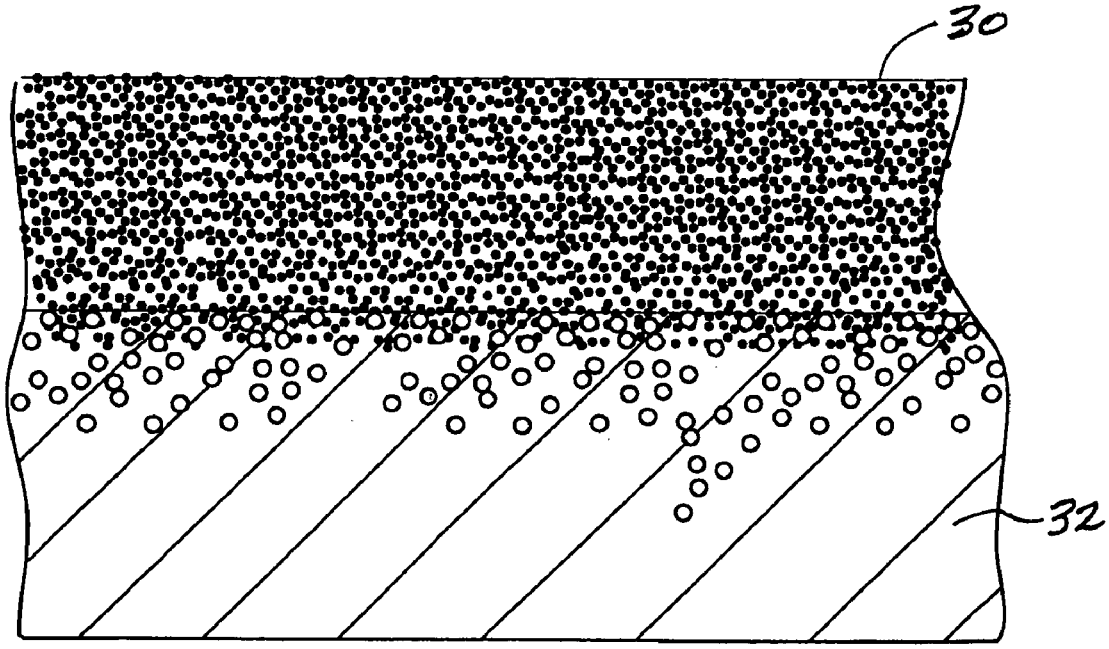
FIG. 4B is a graphical representative of micrograph showing aluminum metallurgically bonded to steel.

As shown in FIG. 4B, the present invention includes core wires having an aluminum outer layer 30 metallurgically bonded to a carbon steel inner portion 32. Preferably, the thickness of such aluminum outer layer 30, is, in one preferred embodiment, approximately 5 percent of the thickness of the core wire. In the case of a round core wire, aluminum outer layer 30 is approximately 10 percent of the radial dimension of the carbon steel core wire.

The aluminum used for metallurgically bonding to the carbon steel core wire is preferably at least 99.5 percent pure aluminum, and is in one preferred embodiment, at least 99.7 percent pure aluminum.

The conductivity of the carbon steel core wire of the present invention has in one preferred embodiment an International Annealed Copper Standard (IACS) conductivity of at least 20.3 percent IACS conductivity.

The carbon steel inner portion 32 of the core wire preferably has a minimum ultimate tensile strength ranging from at least 200 ksi to at least 256 ksi, and a minimum one percent yield strength ranging from at least 170 ksi to at least 210 ksi.

In example applications of the present invention, wire in accordance with the present invention may be developed in categories such as, high strength (HS), extra high strength (EHS), and ultra high strength (UHS) having minimum performance characteristics as set forth in the Table below.

It is to be understood, however, that the present invention is not limited to the foregoing examples of wire, and that variations of the above described component and material parameters, technical specifications, and criteria concerning the construction of cable of the present invention can be made without departing from the teachings of the present invention.

Because of the metallurgical bonding of the aluminum to the carbon steel inner portion of the core wire, the cable of the present invention is anticipated to provide superior corrosion resistance as compared to galvanized carbon steel wire, or other types of coated wire.

Furthermore, for a given diameter, as compared to prior galvanized steel coated wire, the cable of the present invention offers the potential for significantly better conductivity and less weight per unit length of power transmission cable.

For structural and conductivity reasons, core wires 12 are preferably generally continuous throughout their length and free from joints, seams and discontinuities.

FIGS. 4A and 4B are provided for illustrative purposes to highlight the distinction between steel wire which is coated with another metal, such as aluminum, shown in FIG. 4A, and steel wire having a metallurgically bonded aluminum layer, shown in FIG. 4B. In FIG. 4A the aluminum coating 40 does not penetrate into steel inner portion 32, but instead is separated therefrom by a boundary layer 42.

In contrast, FIG. 4B illustrates aluminum metallurgically bonded to steel, such as through a cladding technique, which could, for example, be accomplished by the compaction of aluminum powder onto the steel inner portion 32, by extruding aluminum onto inner portion 32, by applying and compressing aluminum strips onto inner portion 32, or by some other process for metallurgically bonding aluminum outer layer 30 to carbon steel inner portion 32.

FIG. 4A illustrates a boundary layer 42 between aluminum coating 40 and steel inner portion 32. FIG. 4B, in contrast to FIG. 4A, boundary layer 42 is generally nonexistent, since the aluminum clad layer 30 migrates into carbon steel layer 32. This migration of aluminum represents a metallurgical bond of the aluminum into the carbon steel 32 and provides in part for the above described benefits imparted to the aluminum-clad power transmission cable of the present invention.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

TABLE

| Size range (in) | | Size range (mm) | | 1% Yield Strength | | | Ultimate Tensile Strength | | |
|---|---|---|---|---|---|---|---|---|---|
| | | | | HS | EHS | UHS | HS | EHS | UHS |
| FROM | TO | FROM | TO | (ksi) | (ksi) | (ksi) | (ksi) | (ksi) | (ksi) |
| 0.0500 | 0.0899 | 1.27 | 2.28 | 190 | 210 | 210 | 210 | 235 | 256 |
| 0.0900 | 0.1199 | 2.29 | 3.05 | 185 | 205 | 205 | 205 | 230 | 251 |
| 0.1200 | 0.1399 | 3.05 | 3.55 | 180 | 200 | 200 | 205 | 225 | 246 |
| 0.1400 | 0.1900 | 3.56 | 4.83 | 170 | 195 | 195 | 200 | 220 | 241 |

What is claimed is:

1. A method of manufacturing an overhead transmission cable, the method comprising:

providing a core wire having a carbon steel inner portion and an aluminum outer layer metallurgically bonded to said carbon steel inner portion; said aluminum outer layer being at least 99.7 percent pure aluminum and having a conductivity of at least 20.3 percent IACS; said core wire having a minimum ultimate tensile strength of at least 200 ksi and a minimum one percent yield strength of at least 170 ksi; and said aluminum outer layer of said at least one core wire being of a thickness of at least ten percent of a thickness of said core wire;

providing a plurality of aluminum conductor wires; and wrapping said aluminum conductor wires in a generally helical manner about said core wire.

2. A method of manufacturing an overhead transmission cable, the method comprising:

providing at least one carbon steel wire having a minimum ultimate tensile strength of at least 200 ksi and a minimum one percent yield strength of at least 170 ksi;

metallurgically bonding at least 99.5 percent pure aluminum to said carbon steel wire to form an aluminum outer layer thereon; said aluminum outer layer having a conductivity of at least 20.3 percent IACS; and said aluminum outer being of a thickness of at least ten percent of a thickness of said carbon steel wire;

providing a plurality of aluminum conductor wires; and wrapping said aluminum conductor wires in a generally helical manner about said aluminum outer layer of said carbon steel wire.

3. A method of manufacturing an overhead transmission cable, the method comprising:

providing at least one carbon steel wire having a minimum ultimate tensile strength of at least 200 ksi and a minimum one percent yield strength of at least 170 ksi;

cladding at least 99.5 percent pure aluminum to said carbon steel wire to form an aluminum outer layer thereon; said aluminum outer layer having a conductivity of at least 20.3 percent IACS; and said aluminum outer being of a thickness of at least ten percent of a thickness of said carbon steel wire;

providing a plurality of aluminum conductor wires; and wrapping said aluminum conductor wires in a generally helical manner about said aluminum outer layer of said carbon steel wire.

* * * * *